US006341830B1

(12) United States Patent
Chun

(10) Patent No.: US 6,341,830 B1
(45) Date of Patent: Jan. 29, 2002

(54) BOTTOM STRUCTURE FOR REFRIGERATORS

(75) Inventor: Gun Sik Chun, Gyeongnam (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/447,817

(22) Filed: Nov. 24, 1999

(30) Foreign Application Priority Data

Nov. 28, 1998 (KR) ..... 98-51558

(51) Int. Cl.[7] ..... A47B 96/04
(52) U.S. Cl. ..... 312/406.2; 312/401; 312/263
(58) Field of Search ..... 312/400, 401, 312/406, 406.2, 263, 265.5

(56) References Cited

U.S. PATENT DOCUMENTS 3,269,789 A * 8/1966 Crowe ..... 312/401 X
3,353,621 A * 11/1967 Clevett, Jr. ..... 312/401 X
3,588,214 A * 6/1971 Stimamiglio ..... 312/406
3,707,243 A * 12/1972 Kitson ..... 312/406.2 X
4,171,150 A * 10/1979 Soderlund ..... 312/263 X
4,580,852 A * 4/1986 Smitte et al. ..... 312/406.2
5,061,019 A * 10/1991 Kubota et al. ..... 312/400
5,168,621 A * 12/1992 Kruck et al. ..... 312/406 X
5,249,857 A * 10/1993 Suzuki ..... 312/263
5,642,923 A * 7/1997 Meacham et al. ..... 312/263 X
5,921,646 A * 7/1999 Hwang ..... 312/263

* cited by examiner

*Primary Examiner*—Peter M. Cuomo
*Assistant Examiner*—Hanh V. Tran
(74) *Attorney, Agent, or Firm*—Birch, Stewart, Kolasch & Birch, LLP

(57) ABSTRACT

A bottom structure for refrigerators containing a base plate made of a synthetic resin through an injection molding process and having a cavity filled with foam, a machine compartment casing engages with the top surface of the base plate and defines a machine compartment of a refrigerator, a fitting elements for engaging the lower edge of an exterior casing with the top surface of the base plate is provided, the base plate may have a plurality of fitting slits on its top surface, while the machine compartment casing may have a plurality of fitting projections at positions corresponding to the fitting slits, the fitting elements may include a fitting groove formed on the top surface of the base plate and a fitting rail formed on the lower edge of the external plate.

11 Claims, 4 Drawing Sheets

BOTTOM STRUCTURE FOR REFRIGERATORS

BACKGROUND OF THE INVENTION

1. Field of the Invention

The present invention relates, in general, to refrigerators and, more particularly, to the bottom structure for refrigerators.

2. Description of the Prior Art

Referring to FIG. 1, the structure for conventional refrigerators is described hereafter. As shown in the drawing, the structure includes an exterior casing 2 and an interior casing 4. The exterior casing 2 consists of a top plate and two side plates, is made of metal plates and defines the exterior of the refrigerator. The interior casing 4 is disposed in the exterior casing 2, is made of a synthetic resin plate and defines a freezer compartment and a refrigerator compartment.

The gap between the exterior and interior casings 2 and 4 is filled with insulating urethane foaming liquid, thereby forming a foam layer. In order to form the foam layer, after the interior casing 4 is positioned in the exterior casing 2, a front center panel 7 is provided at the front of the exterior casing 2, a bottom plate 8 is provided at the bottom of the exterior casing 2 and a back plate 6 is provided at the rear of the exterior casing 2. Thereby, the gap between the exterior and interior casings 2 and 4, through which the insulating urethane foaming liquid is able to leak, is blocked.

Incidentally, a compressor base plate 10 is positioned under the rear part of the bottom plate 8 so as to define a machine compartment and support a compressor (not shown) mounted in the machine compartment.

In brief, according to the conventional structure of the refrigerator, the lower structure of the refrigerator consists of the bottom plate 8 and the compressor base plate 10.

In the conventional structure of the refrigerator, the exterior casing 2, the bottom plate 8 and the compressor base plate 10 are made of metal plates. When the conventional structure is made of the metal plates, the connection strength between the parts of the structure is lacking, thus being easily damaged by the external impact. In particular, when an external impact is applied to the structure as may occur in the case where the refrigerator is transported or the refrigerator is set down on the floor, the connecting portion between the external casing 2 and the bottom plate 8 may be broken or deformed, thus showing a defect in strength. Such a defect is also found in the connecting portion between the exterior casing 2 and the compression base plate 10.

Further, since the lower portion of the refrigerator is made of metal, the total weight of the refrigerator is not only heavy, but the manufacturing cost of the refrigerator is high.

Additionally, the assembly of the refrigerator is difficult because screws are required to assemble together the metal plates, such as the external casing 2 and the bottom plate 8.

Besides, after the external plate 2 is connected with the bottom plate 8, it is needed to seal the gap between the external portion 2 and the bottom plate 8. When the gap between the external portion 2 and the bottom plate 8 is filled with a foaming liquid so as to seal the connecting portion, the foaming liquid may leak out through the gap, thus causing a defect in the product.

SUMMARY OF THE INVENTION

Accordingly, the present invention has been made keeping in mind the above problems occurring in the prior art, and an object of the present invention is to provide a lower structure of a refrigerator having improved impact resistance.

Another object of the present invention is to provide a lower structure of a refrigerator, allowing its parts to be simplified, thereby reducing manufacturing cost and improving assembly efficiency.

In order to accomplish the above object, the present invention provides a bottom structure for refrigerators, comprising the base plate made of synthetic resin utilizing an injection molding process and having a cavity filled with foam, a machine compartment casing engaging with the top surface of the base plate and defining a machine compartment of a refrigerator and fitting means for engaging the lower edge of an exterior plate with the top surface of the base plate.

In another embodiment, the base plate may have a plurality of fitting slits on its top surface, while the machine compartment casing may have a plurality of fitting projections at positions corresponding to the fitting slits.

In a further embodiment, the fitting means may comprise a fitting groove formed on the top surface of the base plate and a fitting rail formed on the lower edge of the external plate.

In yet another embodiment, the base plate may be partially made of metal at a machine-seating portion.

In a still further embodiment, the machine compartment casing may be formed of synthetic resin.

In an additional embodiment, the base plate may be formed with a foaming liquid inlet on its top surface, the foaming liquid inlet communicating with the cavity of the base plate and a gap between the exterior and interior casings.

In another embodiment, the corners or the edges of the machine compartment casing may be rounded off.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
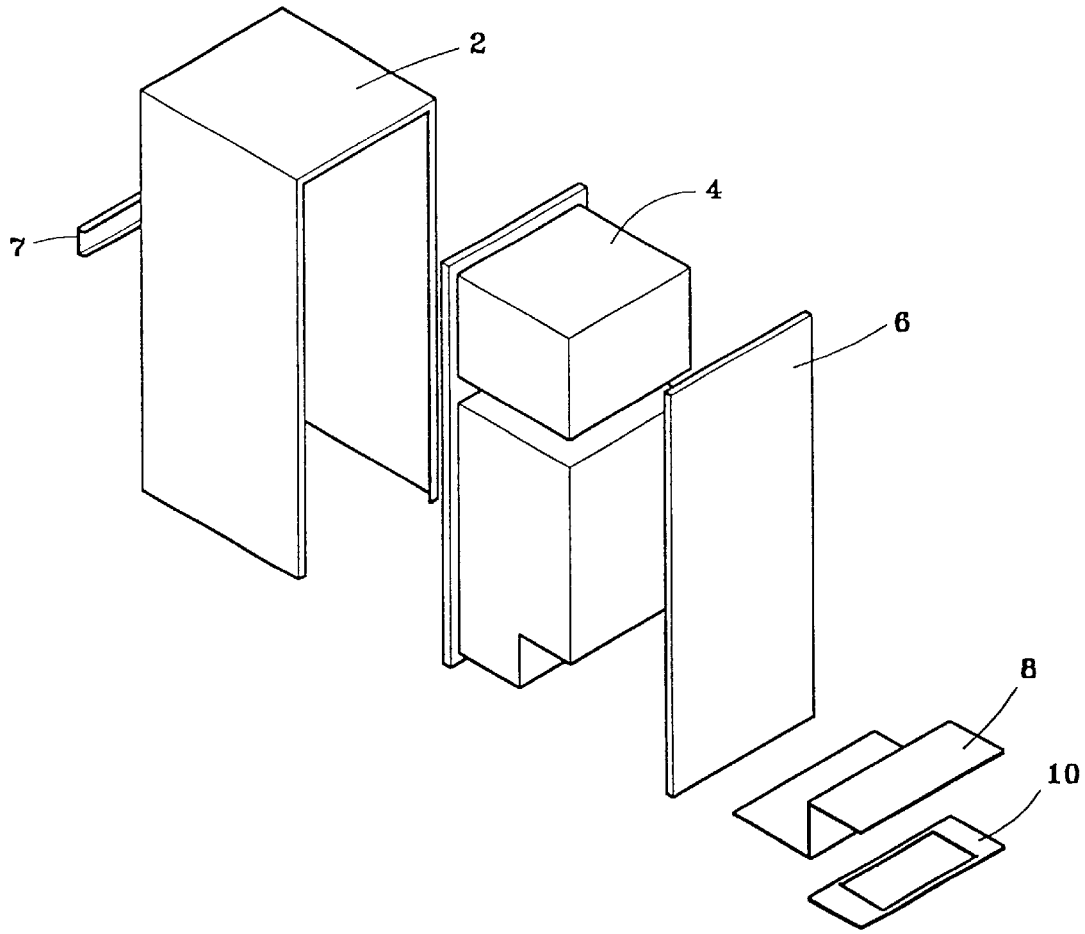
FIG. 1 CONVENTIONAL ART
FIG. 1 is an exploded perspective view showing the structure of a conventional refrigerator.
Figure 2:
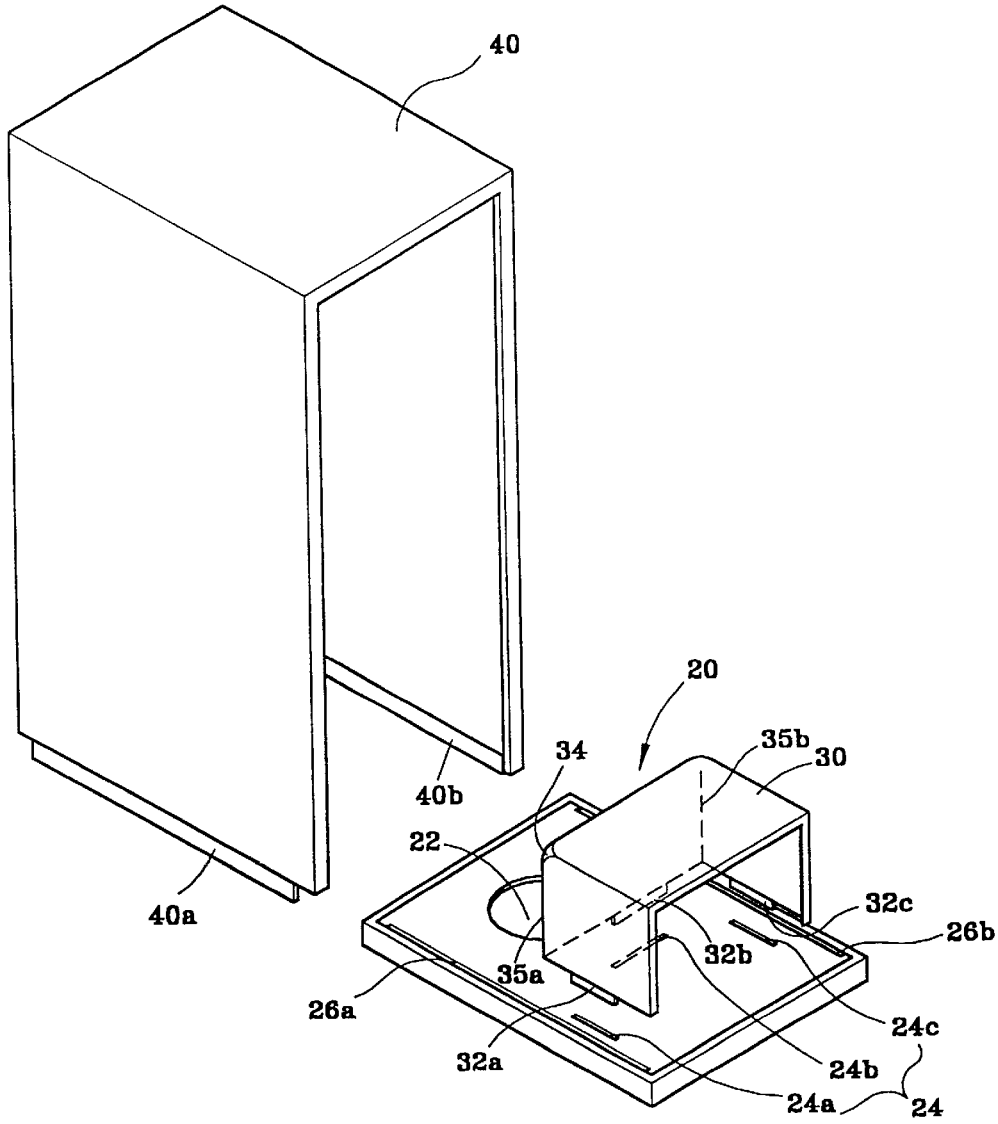
FIG. 2 is an exploded perspective view showing the structure of a refrigerator according to an embodiment of the present invention.

FIG. 2 is an exploded perspective view showing a structure of a refrigerator according to an embodiment of this invention. As shown in the drawing, a base plate 20 is made of synthetic resin through an injection molding process, the base plate 20 being assembled together with the lower end of an external casing 40 and forming the bottom of the refrigerator. That is, one piece of plate manufactured by the injection molding process forms the bottom of the refrigerator. This featured structure of the embodiment differs from the lower structure of a conventional refrigerator on that the bottom of a conventional refrigerator is formed by two pieces of metal plates consisting of a bottom plate and a compressor base plate.

Since the base plate 20 is formed of a synthetic resin through an injection molding process, the base plate 20 is made of a single piece of plate, thereby allowing the construction of the part to be simplified with improved impact resistance.

Figure 3:
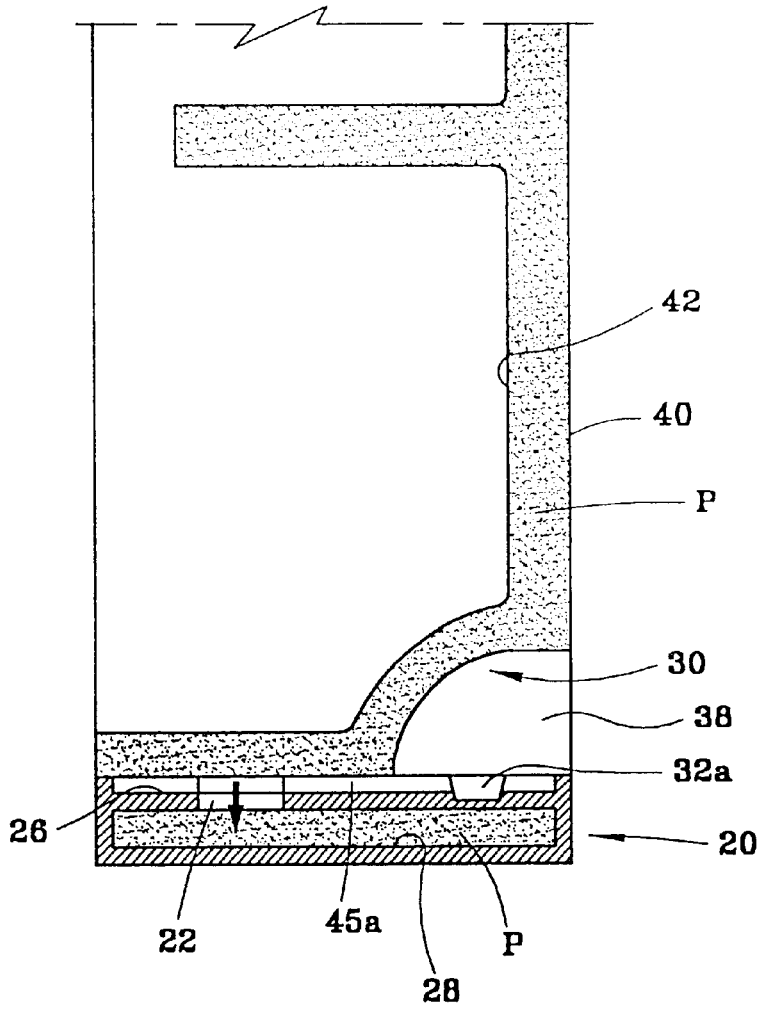
FIG. 3 is a vertical, sectional view showing the structure of a refrigerator according to an embodiment of the present invention.

As shown in FIG. 3, the base plate 20 has a cavity 28 at its middle portion, the cavity 28 being capable of being filled with foam in the process of foaming the insulating material of the refrigerator. Therefore, the base plate 20, which has the cavity 28 filled with foam, is made by filling the cavity 28 with a foaming liquid through a foaming liquid inlet 22 formed on the top surface of the base plate 20.

The process for filling the cavity 28 with a foaming liquid is desired to be integrated with the process for filling the gap between the exterior and interior casings 40 and 42. Therefore, in the process of filling the gap between the exterior and interior casing 40 and 42, the foaming liquid flows into the base plate 20 through the foaming liquid inlet 22, thereby forming a single body of foam P.

As shown in FIG. 2, a machine compartment casing 30, which defines a machine compartment, is also made of a synthetic resin through an injection molding process, a compressor and a condenser (not shown) being mounted within the machine compartment. In detail, when the machine compartment casing 30 is assembled together with the base plate 20, the machine compartment casing 30 defines the machine compartment in the lower rear portion of the refrigerator. Since the compartment casing 30 is made of synthetic resin, the impact resistance of the machine compartment casing 30 is improved.

The base plate 20 has a plurality of fitting slits 24*a*, 24*b* and 24*c* on its top surface, while the machine compartment casing 30 has a plurality of fitting projections 32*a*, 32*b* and 32*c* at positions corresponding to the fitting slits 24*a*, 24*b* and 24*c*. Consequently, when the machine compartment casing 30 is assembled together with the base plate 20, the fitting projections 32*a*, 32*b* and 32*c* are fitted into the fitting slits 24*a*, 24*b* and 24*c*, thus allowing the assembly of the base plate 20 and the machine compartment casing 30 to be easy.

In this embodiment, the machine compartment casing 30 is made of a synthetic resin material. However, it should be understood that the casing 30 may be made of metal without affecting the functioning of this invention. Of course, it should be also understood that such a machine compartment casing, made of metal, has the same construction as that described above.

According to this embodiment, the corners 34 of the machine compartment casing 30 are rounded off. By this, vortices are prevented in the machine compartment casing 30 when air flows into the machine compartment casing 30 so as to cool the compressor and the condenser in the machine compartment casing 30, thereby helping air to flow smoothly through the machine compartment casing 30.

The inner vertical edges 35*a* and 35*b* of the machine compartment casing 30 are shown to be sharp in FIG. 2, but are preferred to be rounded off.

The base plate 20 is provided with two fitting grooves 26*a* and 26*b* on its top surface, while the exterior casing 40 is provided with two fitting rails 40*a* and 40*b* on its lower edge. The base plate 20 and the external plate 40 are assembled together by, inserting the fitting rails 40*a* and 40*b* of the exterior casing 40 into the fitting grooves 26*a* and 26*b* of the base plate 20. Consequently, the engagement structure allows the exterior casing 40 to easily be assembled with the base plate 20.

The assembly process and the foaming process of the bottom structure for refrigerators, according to this embodiment, are described in the following.

As shown in FIGS. 2 and 3, the machine compartment casing 30 is assembled together with the base plate 20. In such a case, the machine compartment casing 30 is fixed into the base plate 20 by engaging the fitting projections 32*a*, 32*b* and 32*c* of the machine compartment casing 30 into the fitting slits 24*a*, 24*b* and 24*c* of the base plate.

The exterior casing 40 is fixed into the base plate 20 while the machine compartment casing 30 is fixed into the base plate 20 . In the fixation of the exterior casing 40 into the base plate 20 the fitting rails 40a and 40b of the exterior casing 40 is engaged into the fitting grooves 26*a* and 26*b* of the base plate 20.

The structure for mounting the internal casing 42 to the interior of the external casing 40 and the structure for mounting a back plate (not shown) over the machine compartment casing 30 coincides with the conventional, corresponding structures. If necessary to fix the internal plate 42 into the base plate 20, the base plate 20 is provided with one or more fitting grooves on its top surface, while the internal plate 42 is provided with one or more fitting rails on its lower edge.

When the above-mentioned parts are all assembled together, the space between the exterior casing 40 and the interior casing 42 is filled with polyurethane foaming liquid. When the space between the exterior casing 40 and the interior casing 42 is filled with polyurethane foaming liquid, the interior of the base plate 20 is filled with the foaming liquid, so that the foam P is formed as shown in FIG. 3. As described above, the interior of the base plate 20 is provided with the cavity 28 and the cavity 28 communicates, with the gap between the external and interior casing 40 and 42 through the foaming liquid inlet 22. Therefore, it is natural that when the space between the exterior casing 40 and the interior casing 42 is filled with polyurethane foaming liquid, the cavity 28 of the base plate 20 is filled with the foaming liquid through the foaming liquid inlet 22, thereby forming the foam P.

Figure 4:
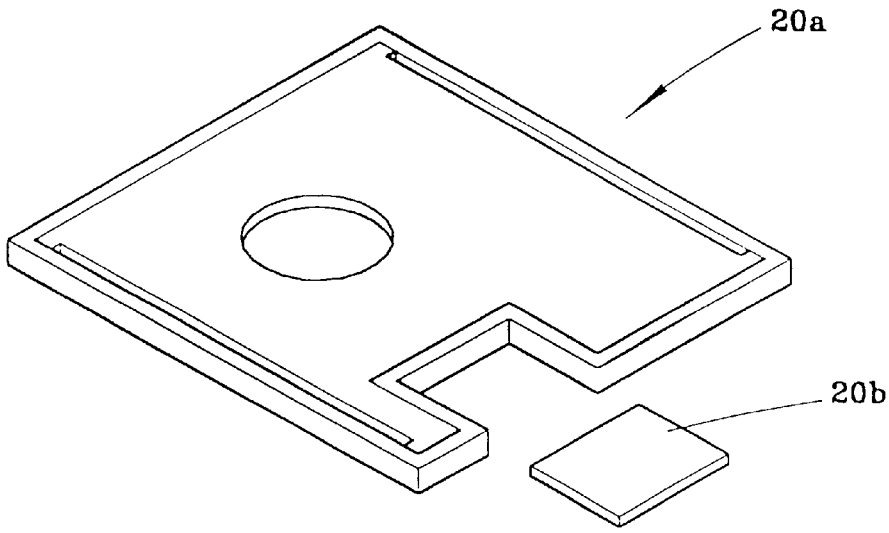
FIG. 4 is the base plate of the structure of a refrigerator according to another embodiment of the present invention.

In FIG. 4, the base plate of the structure of a refrigerator according to another embodiment of the present invention is illustrated. When a heavy machine, such as a heavy compressor, is mounted at the base plate 20, it is possible that a machine-seating portion of the base plate 20 is made of high strength metal and fixed to the remaining portion of the base plate 20 made of synthetic resin, thereby forming a complete base plate 20.

The present invention has the following features.

The bottom of a refrigerator consists of a single piece of the base plate 20 made of synthetic resin. The interior of the base case plate 23 is provided with the cavity 28, the cavity 28 being filled with an insulating material. The machine compartment casing 30, which defines a machine compartment by being connected to the base plate 20, may be selectively made of synthetic resin.

As shown in FIG. 4, it is possible to make a certain portion of the base plate 20 of metal. It is for improving the strength of the base plate 20 to make the portion of the base plate 20.

Additionally, the base plate 20 is provided with the fitting grooves 26*a* and 26*b* and the fitting slits 24*a*, 24*b* and 24*c*.

According to the present invention, the below mentioned effects are obtained.

In this invention, a single piece of a base plate constitutes the bottom of the refrigerator. Therefore, the strength of the bottom of the refrigerator is improved. In addition, since the weight of the bottom is lowered by making the base plate of synthetic resin, the transportation of the parts and manufactured products is easy.

The impact resistance of the base place is improved because the base plate of synthetic resin is not only made of synthetic resin, but has a cavity filled with synthetic resin. That is, the bottom structure of this invention absorbs external impact that is exerted to the structure during the transportation and the installation of the refrigerator. Since this improved impact resistance prevents the refrigerator from being damaged, the reliability of the refrigerator improves.

Further, since the bottom structure has easy and tight fitting constructions, the bottom structure is easily assembled and prevents the leakage of foaming liquid.

In the process of the injection molding of a machine compartment casing, the corners or edges of the machine compartment casing may be rounded off. This prevents vortices that are generated by airflow, the airflow entering the machine compartment casing so as to cool the compressor and the condenser installed in the machine compartment casing. By this, the noise of the refrigerator is minimized, while its heat dissipation effect is maximized.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A structure for refrigerators, comprising:

a base plate made of a synthetic resin containing a cavity adapted to receive a foam, said base plate being partially made of metal defining a machine-seating portion a machine compartment casing engaged with a top surface of the base plate and defining a machine compartment of the refrigerator; and an external casing provided with fitting elements at a lower edge thereof for engaging with the top surface of the base plate.

2. The structure according to claim 1, wherein the machine compartment casing is made of a synthetic resin material.

3. The structure of claim 1, wherein the base plate is made by an injection molding process.

4. The structure of claim 1, wherein the cavity of the base plate contains a foam.

5. A structure for refrigerators, comprising:

an external and internal casing defining a gap therebetween, a base plate made of a synthetic resin containing a cavity adapted to receive a foam, a foaming liquid inlet providing communication between the cavity of the base plate and the gap between the exterior and interior casings, a machine compartment casing engaged with a top surface of the base plate and defining a machine compartment of the refrigerator; and fitting elements providing engagement between a lower edge of the exterior casing and the top surface of the base plate.

6. The structure according to claim 5, wherein the fitting elements comprise:

a fitting groove formed on the top surface of said base plate; and a fitting rail formed on the lower edge of said external casing.

7. The structure according to claim 5, wherein the base plate is partially made of metal defining a machine seating portion.

8. The structure of claim 5, wherein the machine compartment casing is made of a synthetic resin material.

9. The structure according to claim 5, wherein the corners or edges of the machine compartment casing are rounded off.

10. The structure of claim 5, wherein the cavity of the base plate contains a foam.

11. The structure of claim 5, wherein the gap is provided with a synthetic resin foam.

* * * * *